US007957684B2

(12) United States Patent
DeHollander et al.

(10) Patent No.: US 7,957,684 B2
(45) Date of Patent: Jun. 7, 2011

(54) INTERMEDIATE TRANSFER BELT AND METHODS FOR MAKING THE SAME

(75) Inventors: David A. DeHollander, Fairport, NY (US); Michael S. Roetker, Webster, NY (US); Scott J. Griffin, Fairport, NY (US); David W. Martin, Walworth, NY (US); Jonathan Herko, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 512 days.

(21) Appl. No.: 12/146,361

(22) Filed: Jun. 25, 2008

(65) Prior Publication Data

US 2009/0324304 A1 Dec. 31, 2009

(51) Int. Cl.
*G03G 15/01* (2006.01)

(52) U.S. Cl. ..... 399/302

(58) Field of Classification Search ..... 399/302, 399/303, 308

See application file for complete search history.

(56) References Cited

U.S. PATENT DOCUMENTS

| | | | | |
|---|---|---|---|---|
| 4,407,580 | A * | 10/1983 | Hashimoto et al. | 399/313 |
| 5,017,969 | A * | 5/1991 | Mitomi et al. | 399/299 |
| 6,141,522 | A * | 10/2000 | Tsuruoka et al. | 399/302 |
| 2003/0206749 | A1 * | 11/2003 | Kashiwabara et al. | 399/121 |
| 2004/0136750 | A1 * | 7/2004 | Yoshioka et al. | 399/162 |
| 2005/0185988 | A1 * | 8/2005 | Mochimaru | 399/165 |
| 2006/0116230 | A1 * | 6/2006 | Satoh et al. | 474/166 |
| 2007/0022861 | A1 * | 2/2007 | Roetker et al. | 83/694 |
| 2007/0206979 | A1 * | 9/2007 | Ohta | 399/302 |
| 2008/0019741 | A1 * | 1/2008 | Lee et al. | 399/302 |

* cited by examiner

*Primary Examiner* — David M Gray
*Assistant Examiner* — Rodney Bonnette
(74) *Attorney, Agent, or Firm* — Pillsbury Winthrop Shaw Pittman LLP

(57) ABSTRACT

An image forming apparatus having an improved intermediate transfer belt, and processes for making the same. More specifically, there is provided an intermediate transfer belt having one or more steering ribs formed into the belt such that a separate steering rib need not be employed.

24 Claims, 2 Drawing Sheets

INTERMEDIATE TRANSFER BELT AND METHODS FOR MAKING THE SAME

BACKGROUND

The present embodiments relate generally to an improved intermediate transfer belt, and processes for making the same. More specifically, embodiments relate to an intermediate transfer belt having one or more steering ribs formed into the belt such that a separate steering rib need not be employed.

Electrophotographic printing is a well-known and commonly used method of copying or printing documents. Electrophotographic printing is performed by exposing a light image representation of a desired document onto a substantially uniformly charged photoreceptor. In response to that light image the photoreceptor discharges, creating an electrostatic latent image of the desired document on the photoreceptor's surface. Toner is then deposited onto that latent image, forming a toner image. The toner image is then transferred from the photoreceptor onto a receiving substrate such as a sheet of paper. The transferred toner image is then fused with the substrate, usually using heat and/or pressure. The surface of the photoreceptor is then cleaned of residual developing material and recharged in preparation for the production of another image.

The foregoing generally describes black and white electrophotographic printing machines. Electrophotographic printing can also produce color images by repeating the above process for each color of toner that is used to make the color image. For example, the photoreceptive surface may be exposed to a light image that represents a first color, say black. The resultant electrostatic latent image can then be developed with black toner particles to produce a black toner layer that is subsequently transferred onto a receiving substrate. The process can then be repeated for a second color, say yellow, then for a third color, say magenta, and finally for a fourth color, say cyan. When the toner layers are placed in superimposed registration the desired composite color toner image is formed and fused on the receiving substrate.

The color printing process described above superimposes the color toner layers directly onto a substrate. Other electrophotographic printing systems use intermediate transfer belts. In such systems successive toner layers are electrostatically transferred in superimposed registration from the photoreceptor onto an intermediate transfer belt. Only after the composite toner image is formed on the intermediate transfer belt is that image transferred and fused onto the substrate. Indeed, some electrophotographic printing systems use multiple intermediate transfer belts, transferring toner to and from the belts as required to fulfill the requirements of the machine's overall architecture.

In operation, an intermediate transfer belt is brought into contact with a toner image-bearing member such as a photoreceptor belt. In the contact zone an electrostatic field generating device such as a corotron, a bias transfer roll, a bias blade, or the like creates electrostatic fields that transfer toner onto the intermediate transfer belt. Subsequently, the intermediate transfer belt is brought into contact with a receiver. A similar electrostatic field generating devices then transfers toner from the intermediate transfer belt to the receiver. Depending on the system, a receiver can be another intermediate transfer member or a substrate onto which the toner will eventually be fixed. In either case the control of the electrostatic fields in and near the transfer zone is a significant factor in toner transfer.

In systems that use intermediate transfer belts, the image forming apparatus may include the intermediate transfer belt and the drive roll for driving it, as well as a steering rib to prevent the intermediate transfer belt from slipping on the drive roll or prevent a zig-zag motion of the belt. Conventionally, the rib is separately manufactured and subsequently attached to the backside of the intermediate transfer belt, e.g., by glue. A common problem encountered with this system is the slippage of the rib off of the belt. The slippage can occur as a result of glue failure or degradation of the glue. Moreover, the rib material is quite costly and thus drives up the overall cost of image forming apparatus.

As such, there is a need for an improved intermediate transfer belt that is cost-effective and can operate without slippage.

SUMMARY

According to embodiments illustrated herein, there is provided an improved intermediate transfer belt having one or more steering ribs formed into the belt such that a separate steering rib need not be employed, and processes for making the same.

In particular, an embodiment provides an intermediate transfer belt, wherein the intermediate transfer belt is made with one or more steering ribs formed directly into the intermediate transfer belt.

Embodiments also provide an image forming apparatus comprising a first transfer apparatus for primarily transferring a toner image formed on an image bearing body onto an intermediate transfer belt, and a second transfer apparatus for secondarily transferring the toner image transferred onto the intermediate transfer belt onto a transfer medium, wherein the intermediate transfer belt is made with one or more steering ribs formed directly into the intermediate transfer belt.

Further embodiments provide an image forming apparatus comprising a first transfer apparatus for primarily transferring a toner image formed on an image bearing body onto an intermediate transfer belt, a second transfer apparatus for secondarily transferring the toner image transferred onto the intermediate transfer belt onto a transfer medium, and one or more drive rolls for driving the intermediate transfer belt, wherein the intermediate transfer belt is made with one or more steering ribs formed directly into the intermediate transfer belt and the drive rolls include receiving grooves for receiving the one or more ribs.

Yet another embodiment provides a method for making an improved image forming apparatus comprising a first transfer apparatus for primarily transferring a toner image formed on an image bearing body onto an intermediate transfer belt, and a second transfer apparatus for secondarily transferring the toner image transferred onto the intermediate transfer belt onto a transfer medium, wherein the intermediate transfer belt is made with one or more steering ribs formed directly into the intermediate transfer belt, the method comprising cutting a belt material to a desired length, overlapping ends of the cut belt material, holding the ends of the cut belt material in place and welding the ends with an ultrasonic horn to form a seamless intermediate transfer belt, and running the seamless intermediate transfer belt between a radial horn and anvil to create a integral steering rib directly in the seamless intermediate transfer belt.

BRIEF DESCRIPTION OF THE DRAWINGS

For a better understanding of the present embodiments, reference may be had to the accompanying figures.

DETAILED DESCRIPTION

In the following description, it is understood that other embodiments may be utilized and structural and operational changes may be made without departure from the scope of the present embodiments disclosed herein.

Figure 1:
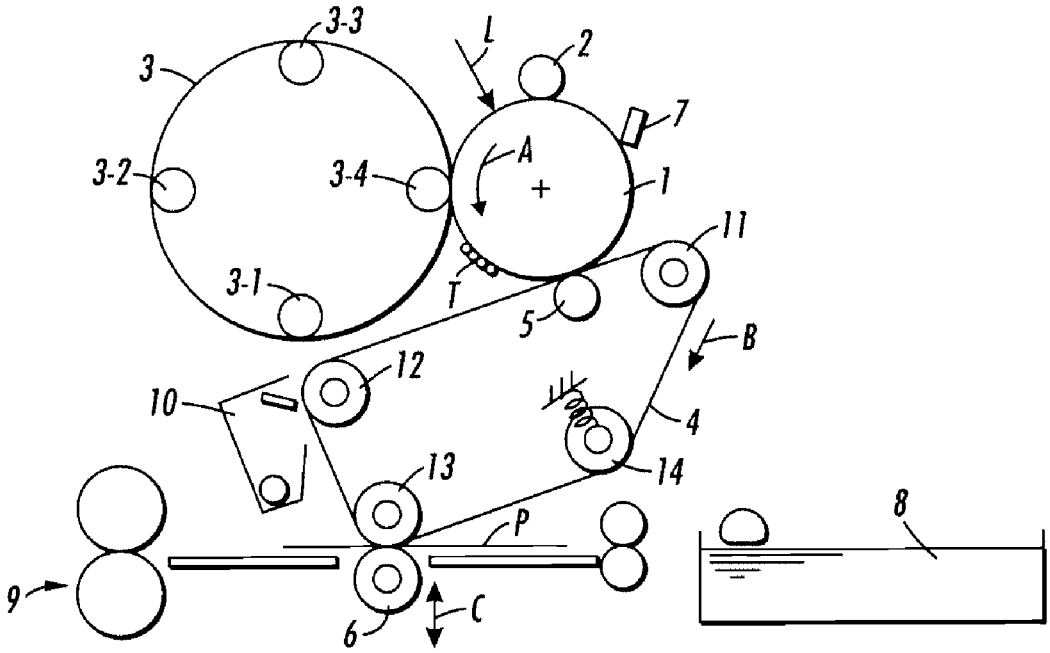
FIG. 1 is a diagram schematically showing a conventional image forming apparatus using an intermediate transfer belt.

A conventional image forming apparatus using an intermediate transfer belt is provided in FIG. 1. As shown, the surface of an electrostatic latent image carrier (which takes the form of a photosensitive drum in the description of the specification) 1 is uniformly charged by a charger 2, and scanned with a laser beam L, so that an electrostatic latent image defined by an image signal of a first color is formed on the surface of the latent image carrier. As the photosensitive drum 1 is rotated in the direction A with an arrow head, the latent image moves and reaches a position facing a developing device of the first color of a developing unit 3, and it is developed into a toner image T by the developing device of the first color. The photosensitive drum 1 carrying the toner image T thereon is further rotated.

An intermediate transfer belt 4 moves at a speed substantially equal to the peripheral speed of the photosensitive drum 1 in harmony with the toner developing operation. In a primary image transfer section in which a primary image transfer roll 5 is disposed in contact with the intermediate transfer belt 4 right under a position where the photosensitive drum 1 comes in contact with the intermediate transfer belt 4, the toner image T is primarily transferred from the photosensitive drum 1 onto the intermediate transfer belt 4 under a transfer electric field which is applied to the primary image transfer roll 5, the polarity of the transfer electric field being opposite to the toner charging polarity. Here, a primary image transferring cycle is completed.

As the intermediate transfer belt 4 travels, the toner image primarily transferred onto the intermediate transfer belt 4 moves and reaches a secondary image transfer section including a secondary image transfer roll 6 disposed therein. In the full-color image forming apparatus, the process ranging from the latent image forming step to the primary image transfer step is repeated a predetermined number of times (generally, for four colors of yellow (Y), magenta (M), cyan (C) and black (Bk)), whereby toner images of a multiple of colors are superposed on the intermediate transfer belt 4 to form a full-color toner image thereon.

To form an image of a multiple of colors, the developing unit 3 is constructed with a rotary machine including four color developing devices; yellow, magenta, cyan and black developing devices 3-1 to 3-4. The developing unit 3 thus constructed sequentially develops the latent images of those colors that are formed on the photosensitive drum 1 into color toner images.

After the toner image of the first color that is carried on the photosensitive drum 1 is transferred from the drum onto the intermediate transfer belt 4 in the primary image transfer section, the following steps are executed: toner left on the surface of the photosensitive drum 1 is removed by a cleaner 7; the surface is neutralized by a discharger (not shown); and an electrostatic latent image for the second color is formed thereon. The latent image of the second color is developed into a toner image of the second color in a similar manner to that in which the latent image of the first color is developed. The toner image of the second color is transferred on the first toner image already transferred on the intermediate transfer belt 4, in a superposing fashion. The toner images of the third and subsequent colors are sequentially superposed on the toner images previously transferred onto the intermediate transfer belt 4. Finally, a multi-color toner image, not yet fixed, which is formed by superposing those toner images on another, is formed on the intermediate transfer belt 4.

A recording medium, e.g., a recording paper P, is fed from a paper tray 8 to the secondary image transfer section at an instant that the intermediate transfer belt 4 carrying the multi-color toner image primarily transferred thereto reaches the secondary image transfer section.

When the recording paper P is transported in a state that it is nipped between the secondary image transfer roll 6 and the intermediate transfer belt 4, the toner image is secondarily transferred from the intermediate transfer belt 4 to the recording paper P under a transfer electric field developed by a transfer voltage applied to the secondary image transfer roll 6, the polarity of the transfer voltage being opposite to the charging polarity of the toner image.

The recording paper P having the toner image secondarily transferred thereonto is transported to a fixing unit 9. The fixing unit 9 heats, under pressure, the toner image to fix it onto the recording paper P. Here, an image forming process is completed. A discharger (not shown) for discharging the recording paper P having the toner image secondarily transferred thereto is located downstream of the secondary image transfer roll 6.

The secondary image transfer roll 6 is movable to and from the intermediate transfer belt 4 in the directions C with arrow heads. The secondary image transfer roll 6 comes in contact with the intermediate transfer belt 4 when the recording paper P approaches to the secondary image transfer roll 6, and it detaches from the intermediate transfer belt 4 when the recording paper P leaves the secondary image transfer roll 6. Upon completion of the secondary image transferring operation, the secondary image transfer roll 6 returns to its stand-by position. A cleaner 10, which is disposed facing the intermediate transfer belt 4, moves to and from the intermediate transfer belt 4 as the secondary image transfer roll 6 so does, to remove the toner image that is left while being not transferred to the recording paper P.

The intermediate transfer belt 4 passes around a drive roll 11, an idle roll 12, a secondary-image-transfer back-up roll 13 and a tension roll 14, and is transported in the direction B with an arrow head by the drive roll 11. The intermediate transfer belt 4 is provided with a control member (not shown) to control the position of the intermediate transfer belt 4 on various rolls, e.g., the drive roll 11 when viewed in the axial direction of each roll.

The surface of the drive roll 11 is coated with a high friction material to prevent the intermediate transfer belt 4 from slipping on the drive roll 11 when loads by the cleaner 10 and the secondary image transfer roll 6 are imparted onto the intermediate transfer belt 4.

In the color image forming apparatus using the intermediate transfer belt, a composite toner image (formed by superposedly transferring color toner images) is transferred onto the recording medium. Therefore, it can effectively prevent the misregistration among the color toner images and the image turbulence, which are essential to the image transfer method in which the color toner images are directly successively transferred from the latent image carrier onto the recording medium.

There are various proposals to prevent a variation of the peripheral speed of the intermediate transfer belt 4 when it travels, to control the intermediate transfer belt 4 to a predetermined position on the drive roll 11, for example, in its axial direction and to prevent breakage occurring at the ends of the intermediate transfer belt 4.

Conventionally, the rib is separately manufactured and subsequently attached to the backside of the intermediate transfer belt, for example, by glue. A common problem encountered with this system is the slippage of the rib off of the belt. The slippage can occur as a result of attachment failure or degradation of the attachment material. Moreover, the rib material is quite costly (e.g., $5 per running foot) and thus drives up the overall cost of image forming apparatus. The present embodiments provide a cost-effective way in which the intermediate transfer belt can operate without slippage.

Figure 2:
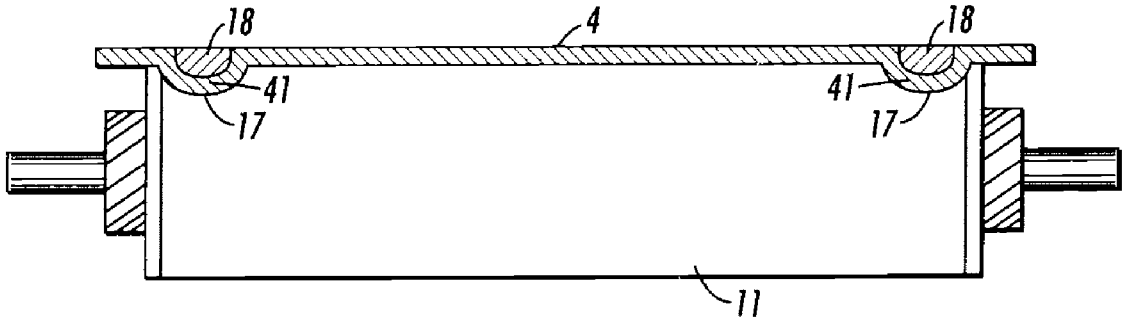
FIG. 2 is a cross sectional view showing a contact of a drive roll with an intermediate transfer belt in a structure including the drive roll and the intermediate transfer belt in accordance with the present embodiments.

FIG. 2 is a cross sectional view showing an embodiment including the drive roll 11 and the intermediate transfer belt 4. As shown, the belt 4 has one or more steering ribs 41 formed into the belt 4. The drive roll 11 includes one or more receiving grooves 17 on the surface which help steer the belt 4. The grooves 17 can be formed in other related rolls in addition to the drive roll 11, in association with the rib 41. A coefficient of friction of the drive roll 11 may be selected to be different from that of the intermediate transfer belt 4 to better the grip of the rib 41 in each respective groove 17. The material used for the drive roll 11 may also be of high friction to further prevent the intermediate transfer belt 4 from slipping. The drive roll 11 may be comprised of aluminum, rubber, and the like, and mixtures thereof. The belt 4 material may be selected from the group consisting of, for example, thermoplastics or other like materials.

Ribs 41 may be provided on both ends of the inner surface of the intermediate transfer belt 4, e.g., the surface opposite to the image carrying surface of the belt 4. Tapes 18 may be provided as reinforcing members for reinforcing the ends of the intermediate transfer belt 4 and are bonded onto both ends of the outer side, e.g., the image carrying surface, of the intermediate transfer belt 4. Each tape may be a polyethylene terephthalate (PET) film of 50 to 100 μm thick.

In further embodiments, the intermediate transfer belt may have a welded seam formed in a number of ways. For example, the intermediate transfer belt may be ultrasonically welded. The intermediate transfer belt may have a seam selected from the group consisting of a welded overlap seam, a welded miter cut seam, and an imageable seam.

In other embodiments, the intermediate transfer belt has a thickness of from about 50 μm to about 150 μm, or from about 70 μm to about 90 μm. The one or more ribs have a width of from about 2 mm to about 10 mm, or from about 5 mm to about 8 mm. The one or more ribs have a depth of from about 1 mm to about 3 mm, or from about 1 mm to about 2 mm.

In embodiments, the intermediate transfer belt 4 is used to form an improved image forming apparatus comprising a first transfer apparatus for primarily transferring a toner image formed on an image bearing body onto an intermediate transfer belt, and a second transfer apparatus for secondarily transferring the toner image transferred onto the intermediate transfer belt onto a transfer medium, wherein the intermediate transfer belt is made with one or more steering ribs formed directly into the intermediate transfer belt. The image forming apparatus may further comprise one or more drive rolls for driving the intermediate transfer belts and the drive rolls may include receiving grooves for receiving the one or more ribs.

Figure 3A:
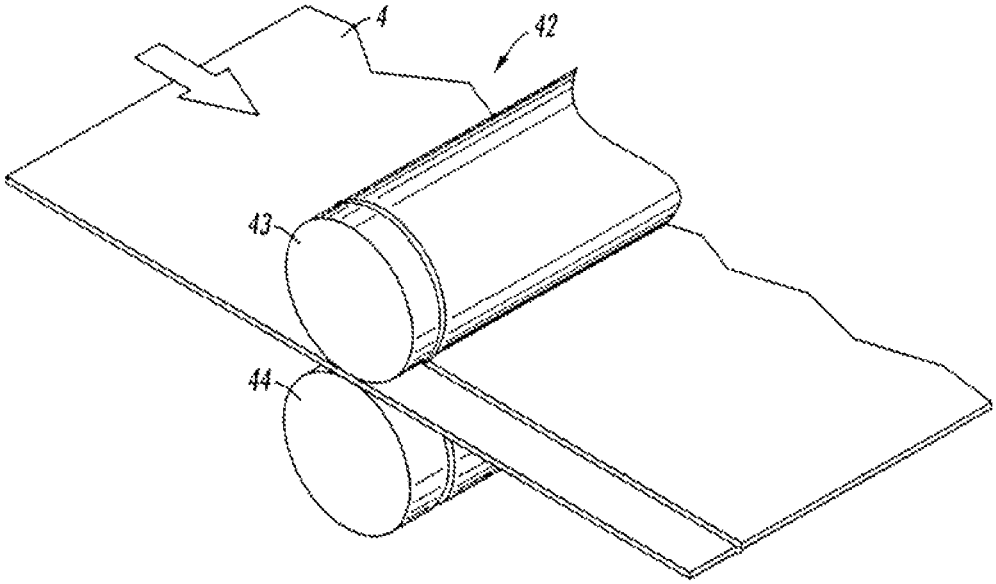
FIG. 3A is a diagram schematically showing the process of making the intermediate transfer belt in accordance with the present embodiments.
Figure 3B:
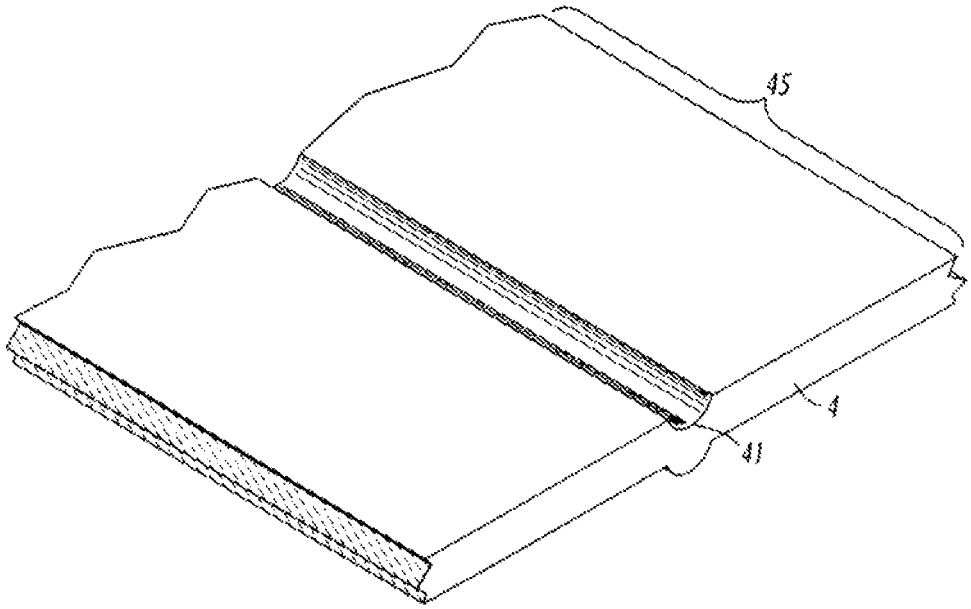
FIG. 3B is a cross sectional view showing an intermediate belt in accordance with the present embodiments.

In further embodiments, a method for making the improved intermediate transfer belts is also provided. As illustrated in FIG. 3A, the intermediate transfer belt is formed by the process comprising providing and welding a web at one or more locations to form an intermediate transfer belt 4. An ultrasonic actuator 42 having a horn 43 and anvil 44 is then applied to the intermediate transfer belt 4 such that the intermediate transfer belt 4 is run between the horn 43 and anvil 44 to form one or more ribs 41 directly into the intermediate transfer belt 4. The ribs 41 are formed such that the one or more ribs 41 run along a circumference or an outside edge 45 of the intermediate transfer belt 4, as shown in FIG. 3B.

In embodiments, a radial ultrasonic actuator is used to create a rib in the belt material. By running the web between the radial horn and anvil, steering ribs can be formed directly into the web for forming the intermediate transfer belt. In this way, the need for attaching a separate steering rib is eliminated. As a result, the possibility of attachment failures such as degradation of glue used to attach the rib to the belt is further eliminated. Because the horn can roll tangentially, the rib can be applied after the belt is welded. In addition, the horn can be made with various patterns to meet specific needs for the rib to be formed.

In welding the belt seam prior to forming the rib, the belt material is cut to length, and the ends are subsequently overlapped. The ends are held in place and an ultrasonic welder performs the weld. At this point, the ribs can be made on the belt. The type of seams that can be used with the present embodiments include overlapped, mitered, or an imageable seam.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An image forming apparatus comprising:

a first transfer apparatus for primarily transferring a toner image formed on an image bearing body onto an intermediate transfer belt; and a second transfer apparatus for secondarily transferring the toner image transferred onto the intermediate transfer belt onto a transfer medium, wherein the intermediate transfer belt is made with one or more steering ribs formed directly into the intermediate transfer belt and wherein the one or more ribs have a width of from about 2 mm to about 10 mm.

2. The image forming apparatus of claim 1 further comprising one or more drive rolls for driving the intermediate transfer belts and wherein the drive rolls include receiving grooves for receiving the one or more ribs.

3. The image forming apparatus of claim 2, wherein the drive roll is comprised of aluminum, rubber and mixtures thereof.

4. The image forming apparatus of claim 2, wherein the drive roll is comprised of a high friction material.

5. The image forming apparatus of claim 1, wherein the intermediate transfer belt is comprised of thermoplastic materials.

6. The image forming apparatus of claim 1, wherein the intermediate transfer belt is ultrasonically welded.

7. The image forming apparatus of claim 1, wherein the intermediate transfer belt has a seam selected from the group consisting of a welded overlap seam, a welded miter cut seam, and an imageable seam.

8. The image forming apparatus of claim 1, wherein the intermediate transfer belt has a thickness of from about 50 μm to about 150 μm.

9. The image forming apparatus of claim 1, wherein the one or more ribs have a depth of from about 1 mm to about 3 mm.

10. An imaging forming device according to claim 1, wherein the intermediate transfer belt is formed by the process comprising: providing and welding a web at one or more locations to form an intermediate transfer belt; applying an ultrasonic actuator having a horn and anvil to the intermediate transfer belt; running the intermediate transfer belt between the horn and anvil; and forming one or more ribs in the intermediate transfer belt such that the one or more ribs run along an outside edge of the intermediate transfer belt.

11. An image forming apparatus comprising:

a first transfer apparatus for primarily transferring a toner image formed on an image bearing body onto an intermediate transfer belt;

a second transfer apparatus for secondarily transferring the toner image transferred onto the intermediate transfer belt onto a transfer medium; and one or more drive rolls for driving the intermediate transfer belt, wherein the intermediate transfer belt is made with one or more steering ribs formed directly into the intermediate transfer belt and the drive rolls include receiving grooves for receiving the one or more ribs and wherein the one or more ribs have a width of from about 2 mm to about 10 mm.

12. The image forming apparatus of claim 11, wherein the drive roll is comprised of aluminum, rubber, and mixtures thereof.

13. The image forming apparatus of claim 11, wherein the intermediate transfer belt is comprised of thermoplastic material.

14. The image forming apparatus of claim 11, wherein the intermediate transfer belt is ultrasonically welded.

15. The image forming apparatus of claim 11, wherein the intermediate transfer belt has a welded overlap seam.

16. The image forming apparatus of claim 11, wherein the intermediate transfer belt has a thickness of from about 70 μm to about 90 μm .

17. The image forming apparatus of claim 11, wherein the one or more ribs have a depth of from about 1 mm to about 2 mm.

18. The image forming apparatus of claim 11, wherein a coefficient of friction of the drive roll is different from that of the intermediate transfer belt.

19. An intermediate transfer belt, wherein the intermediate transfer belt is made with one or more steering ribs formed directly into the intermediate transfer belt and wherein the one or more ribs have a width of from about 2 mm to about 10 mm.

20. A method for making an improved image forming apparatus comprising a first transfer apparatus for primarily transferring a toner image formed on an image bearing body onto an intermediate transfer belt, and a second transfer apparatus for secondarily transferring the toner image transferred onto the intermediate transfer belt onto a transfer medium, wherein the intermediate transfer belt is made with one or more steering ribs formed directly into the intermediate transfer belt, the method comprising:

cutting a belt material to a desired length;

overlapping ends of the cut belt material;

holding the ends of the cut belt material in place and welding the ends with an ultrasonic horn to form a seamless intermediate transfer belt; and running the seamless intermediate transfer belt between a radial horn and anvil to create a integral steering rib directly in the seamless intermediate transfer belt.

21. The method of claim 20, wherein the improved image forming apparatus further comprises one or more drive rolls for driving the intermediate transfer belts and wherein the drive rolls include receiving grooves for receiving the one or more ribs.

22. The method of claim 20, wherein the intermediate transfer belt has a thickness of from about 50 μm to about 150 μm.

23. The method of claim 20, wherein the one or more ribs have a width of from about 2 mm to about 10 mm.

24. The method of claim 20, wherein the one or more ribs have a depth of from about 1 mm to about 3 mm.

* * * * *